US007673605B2

(12) United States Patent
Hiramatsu et al.

(10) Patent No.: US 7,673,605 B2
(45) Date of Patent: Mar. 9, 2010

(54) ROCKER ARM AND METHOD OF MANUFACTURING SAME

(75) Inventors: Naoki Hiramatsu, Hekinan (JP); Akira Takeuchi, Nishio (JP); Kimihiko Todo, Aichi (JP); Tomiyasu Hirano, Gamagori (JP); Yoshio Kawatake, Osaka (JP)

(73) Assignees: Otics Corporation, Aichi (JP); Nakanishi Metal Works Co., Ltd., Osaka (JP)

( * ) Notice: Subject to any disclaimer, the term of this patent is extended or adjusted under 35 U.S.C. 154(b) by 282 days.

(21) Appl. No.: 11/700,110

(22) Filed: Jan. 31, 2007

(65) Prior Publication Data

US 2007/0175428 A1 Aug. 2, 2007

(30) Foreign Application Priority Data

Feb. 2, 2006 (JP) ..... 2006-026174

(51) Int. Cl.
*F01L 1/18* (2006.01)

(52) U.S. Cl. ..... 123/90.39; 29/888.2; 74/559

(58) Field of Classification Search ..... 123/90.39, 123/90.44; 29/888.2; 74/559, 567, 569
See application file for complete search history.

(56) References Cited

U.S. PATENT DOCUMENTS

| | | | | |
|---|---|---|---|---|
| 5,720,245 | A | 2/1998 | Calka | |
| 6,425,361 | B1 | 7/2002 | Motohashi | |
| 6,615,635 | B2 * | 9/2003 | Ammon | 72/379.2 |
| 2004/0000277 | A1 | 1/2004 | Motohashi | |

FOREIGN PATENT DOCUMENTS

| | | |
|---|---|---|
| EP | 1 057 980 | 12/2000 |
| EP | 1 375 830 | 1/2004 |
| JP | 2001-191139 | 7/2001 |
| JP | 2001-198641 | 7/2001 |
| JP | 3207223 | 7/2001 |
| WO | 2005/021183 | 3/2005 |

* cited by examiner

*Primary Examiner*—Ching Chang
(74) *Attorney, Agent, or Firm*—Wenderoth, Lind & Ponack L.L.P.

(57) ABSTRACT

A rocker arm that is rockably attached to a cylinder head actuates a valve by a guide groove that is formed at an end thereof engaging with an upper end of a valve stem, and a roller that is mounted in a roller housing portion of the arm main unit contacting against a cam and rocking. The guide groove is formed by press working ends of the arm main unit in the thickness direction of the plate material to form a pair of walls, and thereafter applying sandwiching pressure in the lateral direction to the walls to increase the height thereof.

10 Claims, 10 Drawing Sheets

ROCKER ARM AND METHOD OF MANUFACTURING SAME

CROSS REFERENCE TO RELATED APPLICATION

This application claims priority from Japanese Patent Application No. 2006-26174 filed on Feb. 2, 2006. The entire content of this priority application is incorporated herein by reference.

TECHNICAL FIELD

This disclosure relates to a rocker arm for actuating a valve of an internal combustion engine, and a method of manufacturing the same.

BACKGROUND

Technology already exists relating to a rocker arm that is manufactured by subjecting a metal plate material to a press forming process (for example, see Japanese Patent No. 3207223 (pages 3 and 4, FIG. 6)). In this case, the side edges of a plate material that were punched into a predetermined shape are turned up to form a pair of retaining walls, a roller for contacting a cam is mounted between the facing retaining walls, and at one end, a guide groove for engaging with the upper edge of the valve stem of the internal combustion engine is formed by press forming the plate material in the plate thickness direction.

However, a depth of a predetermined amount or more is required for the guide groove so that the engagement with the valve stem does not disengage and the valve stem is not swayed by rocking of the rocker arm. In this case, when the plate material is pressed in the thickness direction thereof to form a guide groove as described above, and when the required depth of the guide groove is large, in some cases the drawing by the press becomes tight and causes the plate material to break at the time of formation. To avoid this situation, it is necessary to use a special material that has sufficient malleability as a plate material, and this leads to increased costs.

SUMMARY

The present invention was completed based on the above-mentioned circumstances, and an object of this invention is to provide a low-cost rocker arm that can be simply manufactured as well as a method of manufacturing the same.

The rocker arm according to the present invention is a cold-formed rocker arm of the cam follower type that is attached to a cylinder head of an internal combustion engine, has a guide groove that accepts a top edge of a valve stem of the internal combustion engine, and rocks to actuate a valve of the internal combustion engine. The manufacturing method according to this invention executes a punching step that punches a plate material into a predetermined shape having a pair of side edges; a press step that forms an initial groove having an opposing pair of guide walls by depressing the punched plate material by a predetermined amount in the thickness direction thereof by pressing a punch against the plate material; and a sandwich pressure step that increases the height of the guide walls by applying sandwiching pressure to the pair of guide walls in a direction from the outside thereof to the inside using a sandwich pressure punch (the guide groove is defined between the pair of guide walls).

According to this invention, since the amount of depression of the groove can be further increased by applying sandwiching pressure to the walls that form the initial groove to raise the height of the walls, the press amount in the thickness direction of the plate material can be reduced so that, even without using a special material, the plate material does not break at the time of pressing.

BRIEF DESCRIPTION OF THE DRAWINGS

Illustrative aspects in accordance with the invention will be described in detail with reference to the following figures wherein.

DETAILED DESCRIPTION

Figure 1:
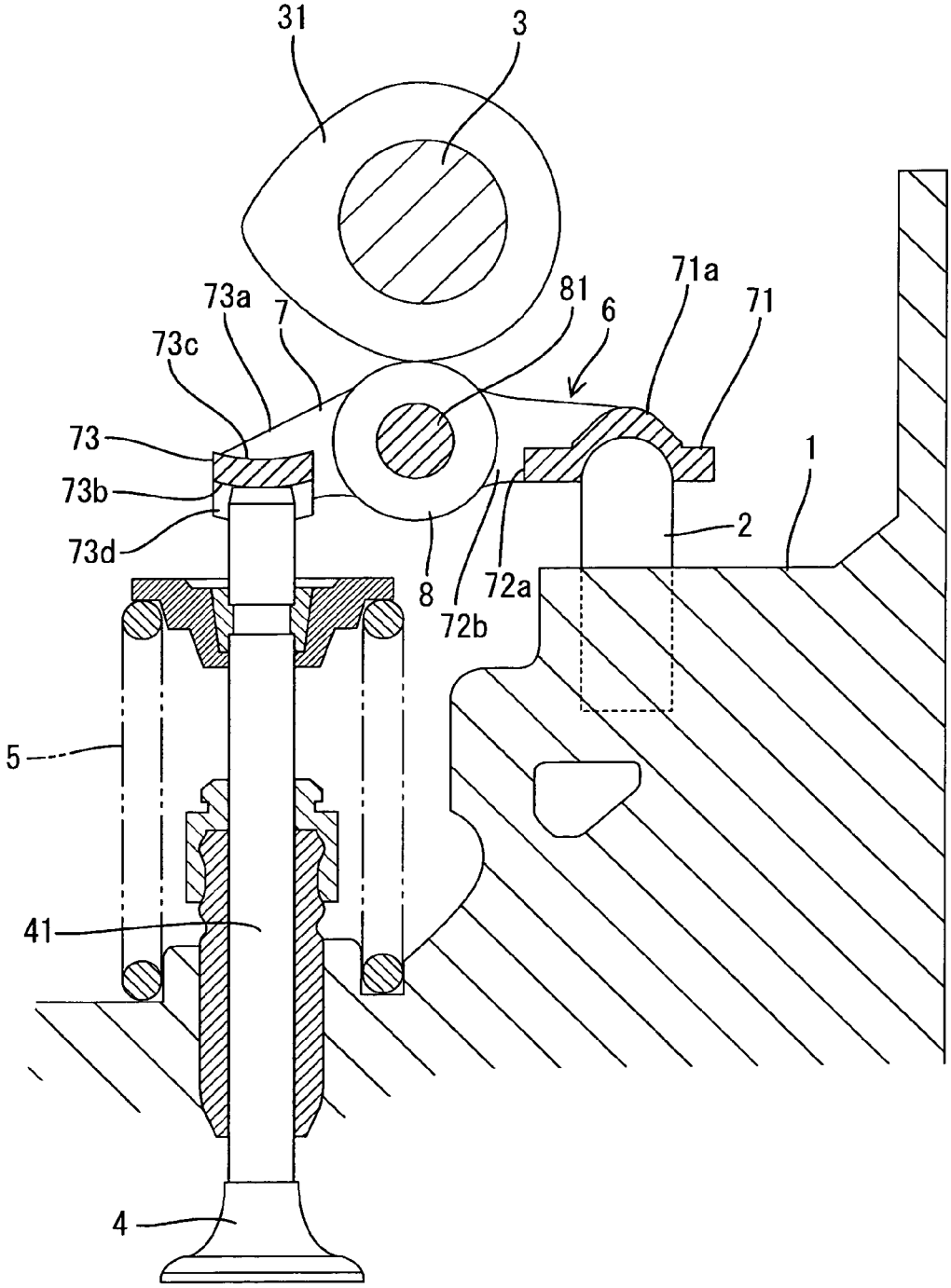
FIG. 1 is a sectional view illustrating a valve gear of an internal combustion engine that applies the rocker arm according to one illustrative aspect.

An illustrative aspect of this invention will now be described with reference to FIGS. 1 to 10. FIG. 1 is a view showing the upper part of an internal combustion engine cylinder head 1. In this case, the cylinder head 1 is provided with a valve gear consisting of a pivot 2 of a rush adjuster, a camshaft 3 having a plurality of cams 31, a valve 4, a valve spring 5 and a rocker arm 6.

The rocker arm 6 is of a roller rocker arm type in which a roller 8 is provided in an arm main unit 7, and the roller 8 comes in contact with the peripheral surface of the cams 31 of the camshaft 3. A rocking support 71 that contacts against the top end of the pivot 2 is formed at one end of the arm main unit 7, and at the other end thereof is formed a valve contacting part 73 that engages with the top end of a valve stem 41 of the valve 4. Thus, in the above described valve gear, when the cams 31 that rotate along with rotation of the camshaft 3 exert a pressing force on the roller 8 such that the rocker arm 6 rocks around the rocking support 71 and the upper end side of the valve stem 41 is subjected to a pressing force in resistance to the valve spring 5, the valve 4 opens and closes each air intake and exhaust port of the internal combustion engine at a predetermined timing.

Figure 3:
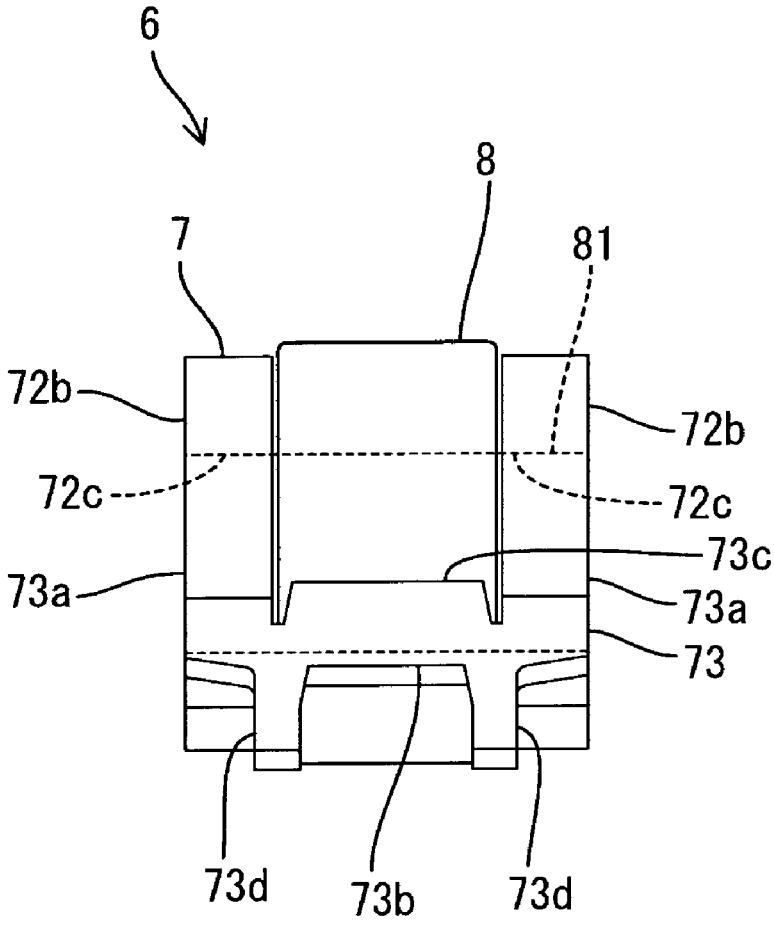
FIG. 3 is a side view of the rocker arm shown in FIG. 2.
Figure 4:
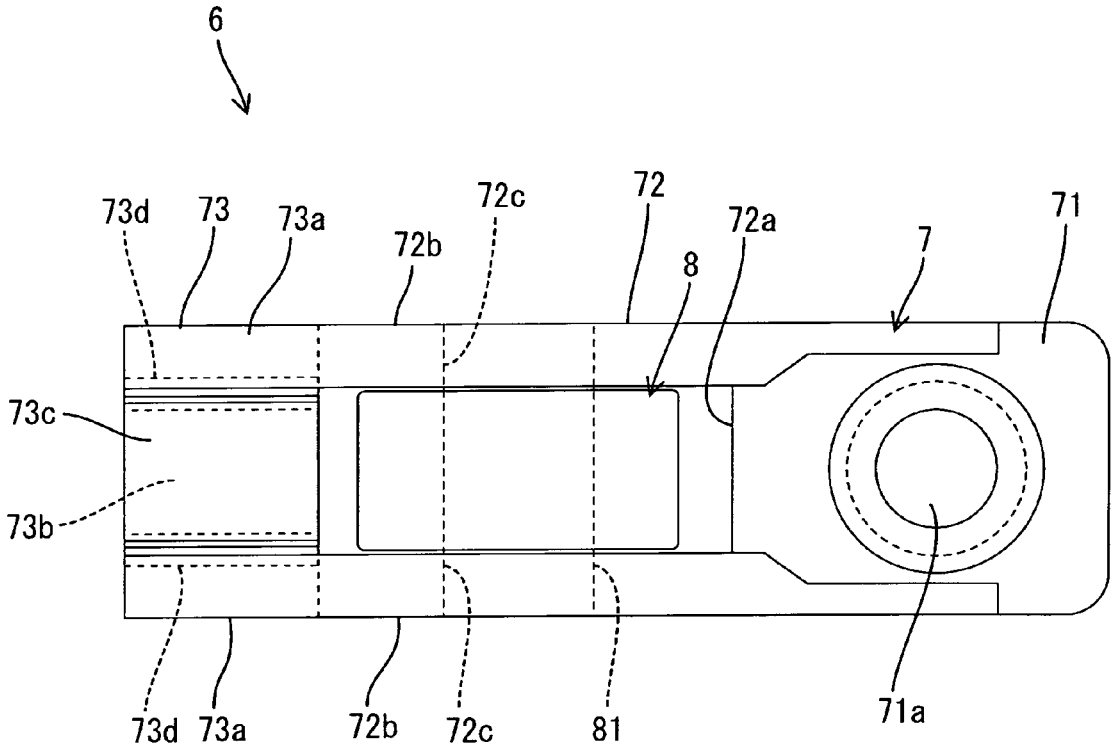
FIG. 4 is a plan view of the rocker arm shown in FIG. 2.
Figure 5:
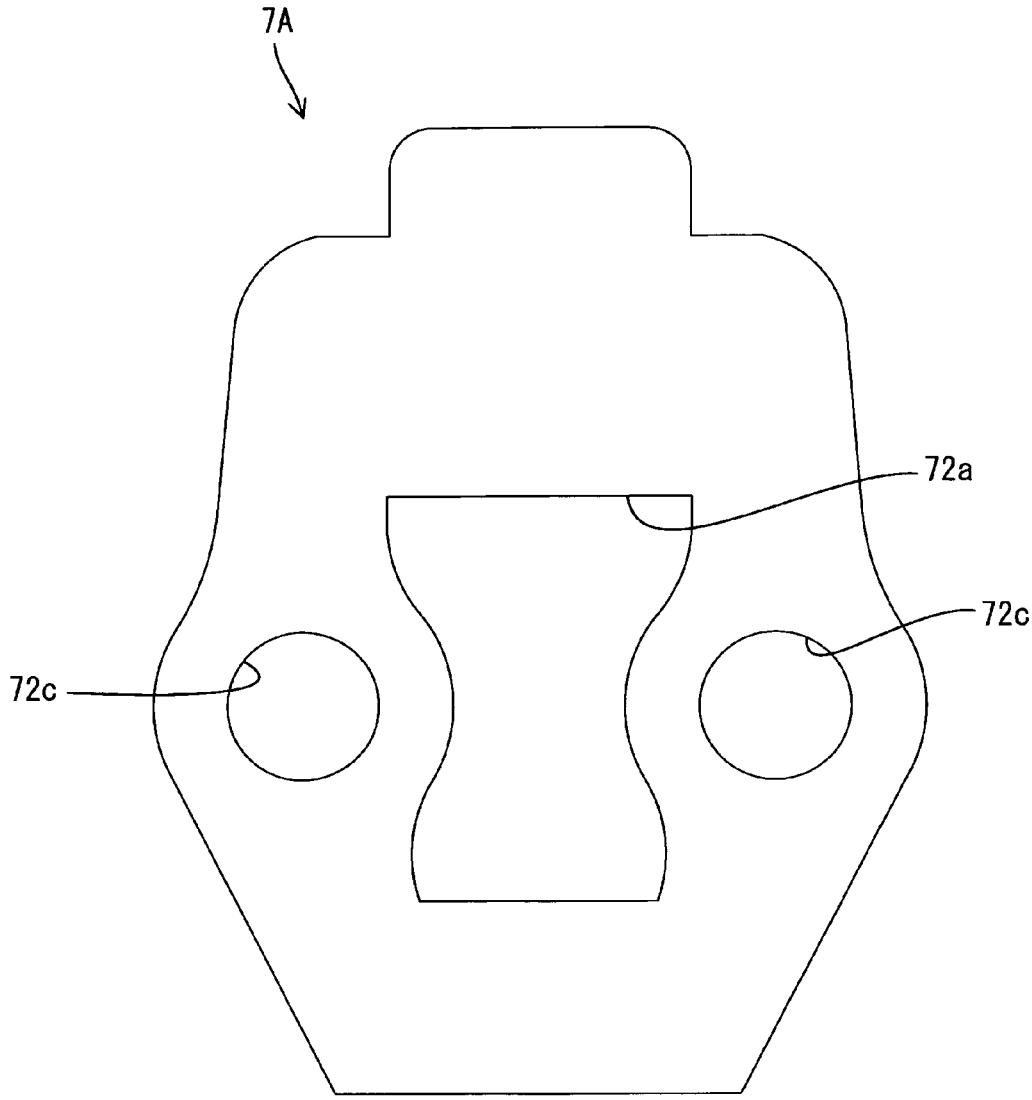
FIG. 5 is a plan view of an punched material that is formed by punching a plate material to form an arm main unit.

The arm main unit 7 is formed as one piece by bending a metal plate by press working, and as shown in FIG. 3, is formed to have a substantially U-shape cross section by bending toward the upper part (in the direction away from the cylinder head). Further, in this illustrative aspect, the arm main unit 7 is formed in a symmetric shape that takes a center line in the lengthwise direction when viewed from a planar perspective as a boundary.

Figure 2:
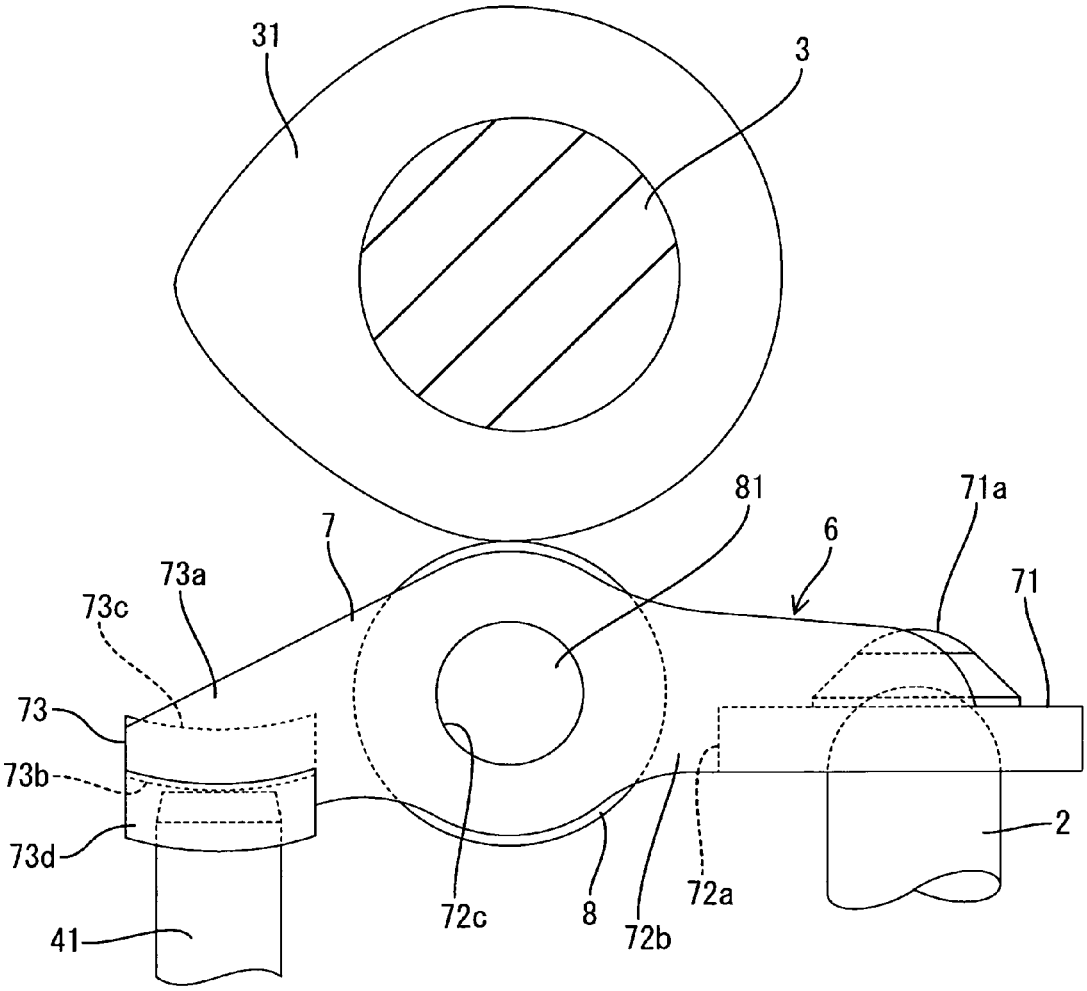
FIG. 2 is an enlarged view of the principal parts shown in FIG. 1.

The center part of the arm main unit 7 forms a roller housing portion 72 for housing the above described roller 8. As shown in FIG. 2, an opening 72*a* for allowing a part of the underside of the roller 8 to protrude externally is formed in the roller housing portion 72. The roller 8 that is housed in the roller housing portion 72 is mounted in a freely rotatable condition by means of a support shaft 81 that passes through the pair of retainer walls 72*b*. In this illustrative aspect, the two retainer walls 72*b* that constitute the roller housing portion 72 are formed to have height dimensions that are substantially equal to the diameter of the roller 8 (in FIG. 2 an example is illustrated in which the height dimensions are such that the end faces of the roller 8 are slightly exposed at the top and bottom), and the top and bottom edges thereof have an arc surface that is consistent with the peripheral surface of the roller 8. A first edge side of the arm main unit 7 constitutes the above described rocking support 71, and at this area a swollen receiving protrusion 71*a* is formed that is made in a dome shape by a drawing process so as to cover the top end of the pivot 2 in an engaged state.

The aforementioned two retainer walls 72*b* of the roller housing portion 72 extend linearly in the same space, and mutually parallel erect walls 73*a* that constitute the valve contacting part 73 are formed at a first edge of the arm main unit 7. The bottom ends of the erect walls 73*a* are connected by a bridge part 73*c*, and a mutually opposing pair of guide walls 73*d* extend downward from the underside of the bridge part 73*c* (see FIG. 3). A guide groove 73*b* that is recessed in an upward direction is formed by the bridge part 73*c* and the guide walls 73*d*. The guide groove 73*b* engages with the valve stem 41 such that the guide walls 73*d* sandwich the top end thereof so that the valve stem 41 does not incline, and the valve 4 is actuated by the underside of the bridge part 73*c* applying a pressing force to the surface at the top end of the valve stem 41. In this connection, the guide groove 73*b* extends in the lengthwise direction of the arm main unit 7, and the width dimension thereof (distance between the guide walls 73*d* shown in FIG. 3) is designed to be roughly the same as the external diameter of the upper end of the valve stem 41 such that it mates therewith. Further, the underside of the bridge part 73*c* that is the contact surface with the valve stem 41 of the guide groove 73*b* is formed in an arc shape so as to always contact against a substantially center part of the upper edge surface of the valve stem 41, regardless of the rocking of the rocker arm 6 (see FIG. 2).

Next, the method of manufacturing the rocker arm 6 according to this illustrative aspect that is configured as detailed above will be described centering on the manufacture of the arm main unit 7. First, a contour shape, an opening 72*a* and a pair of shaft holes 72*c* for mounting the support shaft 81 of the roller 8 are punched in a tabular metal plate using a die, to thereby form an punched material 7A (see FIG. 5).

Figure 6:
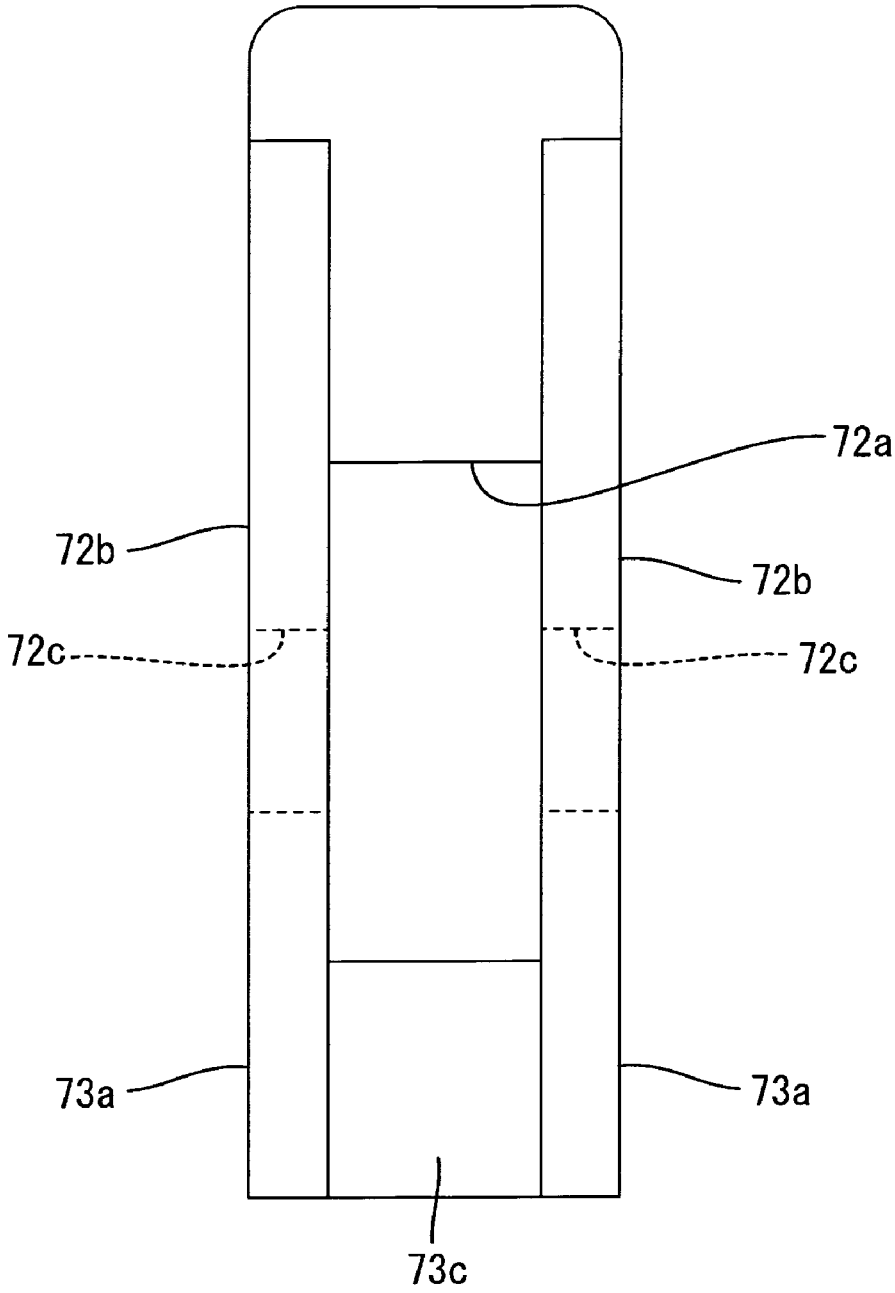
FIG. 6 is a plan view illustrating a state in which the side edges of a punched material are bent upward to form a roller housing portion.
Figure 7:
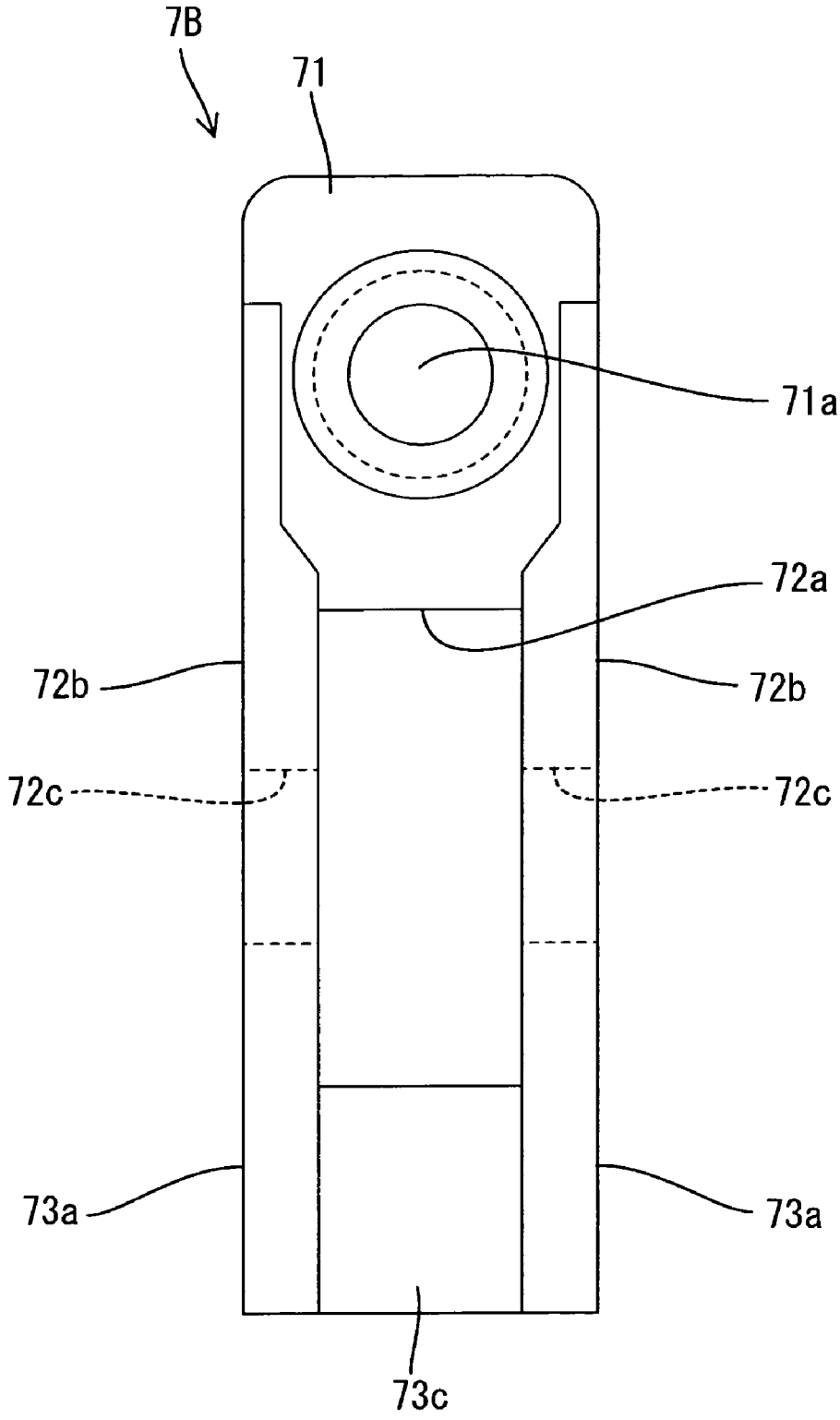
FIG. 7 is a plan view illustrating a state in which a receiving protrusion of a rocking support is further formed at one end.
Figure 8:
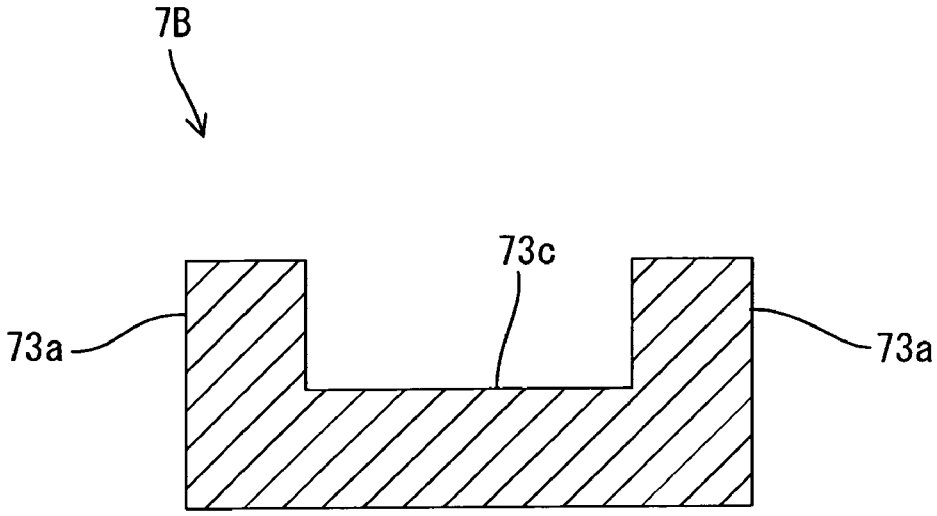
FIG. 8 is a sectional view illustrating the state of the other end before forming a guide groove in the arm main unit.
Figure 9:
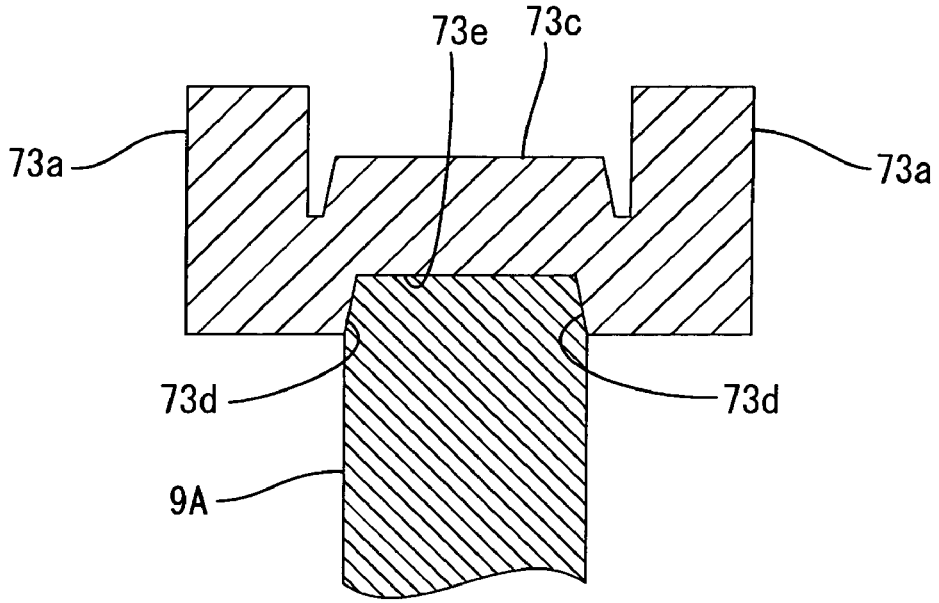
FIG. 9 is a sectional view illustrating a method that forms an initial groove at the other end of the arm main unit.

Subsequently, a pair of side edges of the punched material 7A that was punched into a predetermined shape are bent upward by press working to simultaneously form the pair of retainer walls 72*b* of the roller housing portion 72, the erect walls 73*a* of the valve contacting part 73 and the bridge part 73*c* (see FIG. 6). Thereafter, a first edge of the punched material 7A is drawn upward by press working to form the receiving protrusion 71*a* of the rocking support 71 and complete an intermediate member 7B (see FIG. 7).

With respect to a second edge of the intermediate member 7B that has a cross section formed in a substantially U-shape (see FIG. 8) as described above, first, as shown in FIG. 9, the bridge part 73*c* is pressed from below (in the thickness direction of the plate material) with a stripper punch 9A to indent the bridge part 73*c* by a predetermined amount in the upward direction and form an initial groove 73*e* that is defined by a mutually opposing pair of walls 73*d* (see FIG. 9). The depth of the initial groove 73*e* is determined by the pressing force of the stripper punch 9A, and the ultimately required depth of the guide groove 73*b* is preferably about half, although the depth is not necessarily limited thereto.

Figure 10:
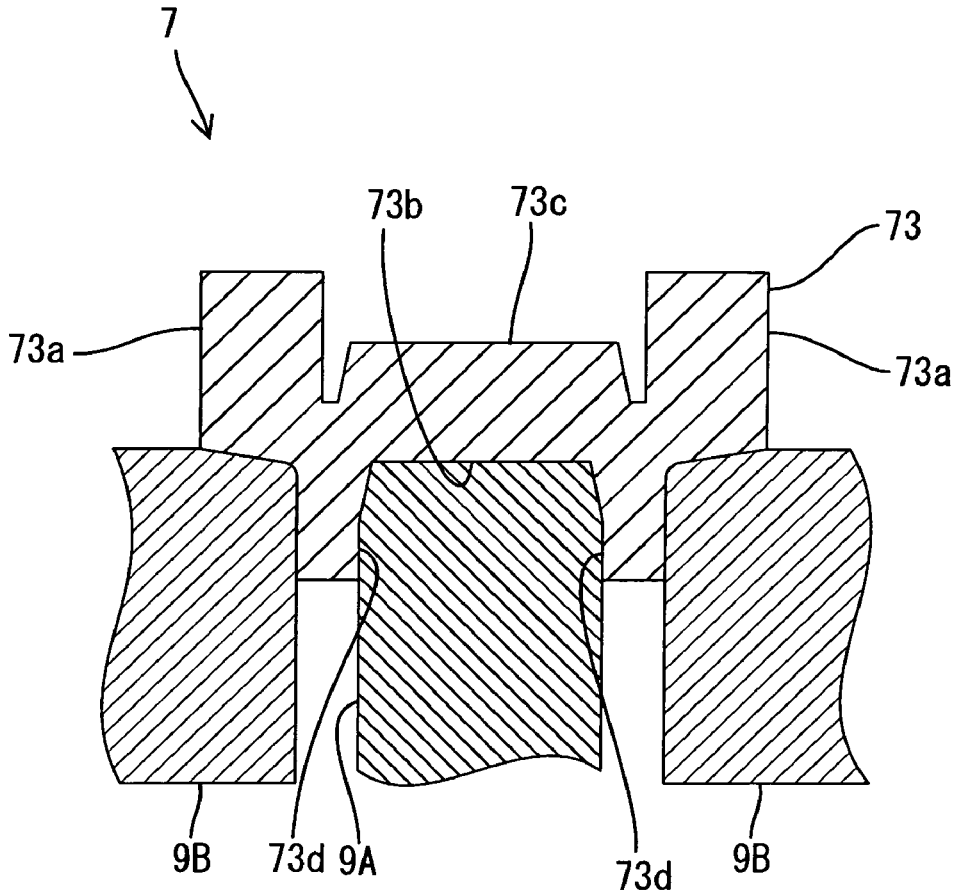
FIG. 10 is a sectional view illustrating a method that forms a guide groove by applying sandwiching pressure to the initial groove.

Thereafter, as shown in FIG. 10, in a state in which the stripper punch 9A remains inserted inside the initial groove 73*e*, the bottom end of each erect wall 73*a* is pressed using a pair of sandwich pressure punches 9B to apply sandwiching pressure in the lateral direction to the walls 73*d* of the initial groove 73*e*. As a result, the material on the outside of the erect walls 73*a* is pushed downward such that the walls 73*d* increase in height to form guide walls 73*d* of a predetermined height, and the guide groove 73*b* is formed by that depression amount increasing further. Finally, the roller 8 is housed in the roller housing portion 72 and the support shaft 81 is passed through the shaft holes 72*c* provided in the retainer walls 72*b* to thereby attach that the roller 8 in a rotatable state between the retainer walls 72*b*.

According to this illustrative aspect, after forming the initial groove 73*e* having the opposing pair of walls 73*d* by press working the plate material in the thickness direction thereof to form a depression of a predetermined amount, sandwiching pressure is applied to the initial groove 73*e* in the lateral direction to increase the height of the walls 73*d* to form the guide walls 73*d*, and thereby form the guide groove 73*b* for which the depression amount was further increased. Thereby, since the amount of pressing in the thickness direction of the plate material can be decreased, it is possible to provide a low-cost rocker arm 6 that can be simply manufactured without the plate material breaking at the time of a press process, even without using a special material, as well as a method of manufacturing the same.

Further, the side edges of the plate material are bent upward to form the pair of retainer walls 72*b* and the rotatable roller 8 is mounted between the retainer walls 72*b*. It is therefore possible to manufacture the roller rocker arm 6 by only press working.

The present invention is not limited to the illustrative aspect described by the above description and drawings and, for example, the following illustrative aspects are also included in the technical scope of this invention:

(1) The present invention is not limited to a roller rocker arm, and can also be applied to a rocker arm of a type that is attached to a rocker shaft and with respect to which a cam contacts an end thereof.

(2) The depth of an initial groove formed by pressing the plate material in the thickness direction can be suitably set in accordance with the plate thickness of the plate material, the kind of material, and the depth of the eventual guide groove.

What is claimed is:

1. A method of manufacturing a rocker arm, the rocker arm being a cold-formed rocker arm of a cam follower type and having a guide groove for accepting a top end of a valve stem of an internal combustion engine, the rocker arm for aft attachment to a cylinder head of the internal combustion engine, and for actuation of a valve of the internal combustion engine, said method comprising:

punching a plate material into a predetermined shape having a bridge part and a pair of side edges;

moving a punch so as to press against the bridge part of the plate material to form an initial groove having an opposing pair of guide walls by depressing the bridge part of the punched plate material by a predetermined amount in a thickness direction of the bridge part of the punched plate material; and moving a sandwich pressure punch to apply sandwiching pressure to each guide wall in the pair of guide walls in a direction transverse to the thickness direction so as to increase the height of each guide wall in the pair of guide walls, while maintaining the punch within the initial groove, the guide groove being defined between the pair of guide walls.

2. The method of manufacturing a rocker arm according to claim 1, wherein said applying sandwiching pressure includes leaving the punch between the pair of guide walls and clamping each guide wall in the pair of guide walls between the punch and the sandwich pressure punch.

3. The method of manufacturing a rocker arm according to claim 2, wherein the sandwich pressure punch is one of a pair of sandwich pressure punches, and said applying sandwiching pressure includes clamping each guide wall in the pair of guide walls between one sandwich pressure punch of the pair of sandwich pressure punches from an external side of each guide wall in the pair of guide walls and the punch at substantially the same time.

4. The method of manufacturing a rocker arm according to claim 2, wherein after said punching a plate material into a predetermined shape and before said pressing a punch against the plate material, bending the side edges of the punched plate material upward.

5. The method of manufacturing a rocker arm according to claim 3, wherein after said punching a plate material into a predetermined shape and before said pressing a punch against the plate material, bending the side edges of the punched plate material upward.

6. The method of manufacturing a rocker arm according to claim 1, wherein the sandwich pressure punch is one of a pair of sandwich pressure punches, and said applying sandwiching pressure includes clamping each guide wall in the pair of guide walls between one sandwich pressure punch of the pair of sandwich pressure punches from an external side of each guide wall in the pair of guide walls and the punch at substantially the same time.

7. The method of manufacturing a rocker arm according to claim 6, wherein after said punching a plate material into a predetermined shape and before said pressing a punch against the plate material, bending the side edges of the punched plate material upward.

8. The method of manufacturing a rocker arm according to claim 1, wherein after said punching a plate material into a predetermined shape and before said pressing a punch against the plate material, bending the side edges of the punched plate material upward.

9. A cold-formed rocker arm of a cam follower type for attachment to a cylinder head of an internal combustion engine having a valve stem, said cold-formed rocker arm comprising:

a metal arm main unit including a first side, a second side opposite the first side, a first portion and a second portion;

a rocking support disposed on the first portion of the arm main unit; and a pair of guide walls disposed on the second portion of the arm main unit by moving a punch so as to press against the first portion of the arm main unit in a thickness direction of the first portion of the arm main unit to depress the arm main unit by a predetermined amount to form an initial groove that is surrounded by the pair of guide walls, and thereafter increasing a height of each guide wall in the pair of guide walls by moving a sandwich pressure punch to apply sandwiching pressure to each guide wall in the pair of guide walls in a direction transverse to the thickness direction, while maintaining the punch within the initial groove;

wherein a guide groove is configured to accept an upper edge of the valve stem of the internal combustion engine and is disposed between the pair of guide walls, and the arm main unit is configured to actuate a valve of the internal combustion engine.

10. The cold-formed rocker arm according to claim 9, wherein the guide walls are disposed on the first side of the arm main unit and first and second retainer walls extend upward from the second side and are disposed on a first edge and the second edge of the arm main unit, respectively, and a roller is rotatably mounted between the first and second retainer walls.

* * * * *